US008391524B2

(12) United States Patent
Gozen

(10) Patent No.: US 8,391,524 B2
(45) Date of Patent: Mar. 5, 2013

(54) HEARING AID, HEARING AID SYSTEM, WALKING DETECTION METHOD, AND HEARING AID METHOD

(75) Inventor: Shinya Gozen, Hyogo (JP)

(73) Assignee: Panasonic Corporation, Osaka (JP)

( * ) Notice: Subject to any disclaimer, the term of this patent is extended or adjusted under 35 U.S.C. 154(b) by 179 days.

(21) Appl. No.: 13/057,227

(22) PCT Filed: Jun. 2, 2010

(86) PCT No.: PCT/JP2010/003684

§ 371 (c)(1),
(2), (4) Date: Feb. 2, 2011

(87) PCT Pub. No.: WO2010/140358

PCT Pub. Date: Dec. 9, 2010

(65) Prior Publication Data

US 2011/0135126 A1 Jun. 9, 2011

(30) Foreign Application Priority Data

Jun. 2, 2009 (JP) ..... 2009-132811

(51) Int. Cl.
*H04R 25/00* (2006.01)

(52) U.S. Cl. ..... 381/317; 381/312; 381/313

(58) Field of Classification Search ..... 381/312–313, 381/316–317, 320

See application file for complete search history.

(56) References Cited

U.S. PATENT DOCUMENTS

| | | | |
|---|---|---|---|
| 6,741,714 | B2 | 5/2004 | Jensen |
| 7,747,031 | B2 | 6/2010 | Steinbuss |
| 7,797,154 | B2 | 9/2010 | Ichikawa |
| 2002/0041696 | A1 | 4/2002 | Jensen |
| 2002/0090098 | A1 | 7/2002 | Allegro et al. |
| 2005/0203735 | A1 | 9/2005 | Ichikawa |
| 2006/0233407 | A1 | 10/2006 | Steinbuss |
| 2008/0306734 | A1 | 12/2008 | Ichikawa |

FOREIGN PATENT DOCUMENTS

| | | |
|---|---|---|
| JP | 10-23590 | 1/1998 |
| JP | 2004-500592 | 1/2004 |
| JP | 2004-511153 | 4/2004 |
| JP | 2005-257817 | 9/2005 |
| JP | 2006-270952 | 10/2006 |
| JP | 3894875 | 12/2006 |

OTHER PUBLICATIONS

International Search Report issued Aug. 3, 2010 in corresponding International Application No. PCT/JP2010/003684.

*Primary Examiner* — Suhan Ni
(74) *Attorney, Agent, or Firm* — Wenderoth, Lind & Ponack, L.L.P.

(57) ABSTRACT

A hearing aid that analyzes a surrounding acoustic environment and automatically switches between a plurality of hearing aid processing reduces noise by limiting directionality, when the user is in a noisy outdoor location. However, in the case where directionality is limited to the front when the user is walking or the like, the user is put in extreme danger because he/she cannot notice sound of danger approaching from behind. Behavior analysis of identifying a walking state of the user is necessary in addition to environmental analysis, but typical walking detection using a sensor as in the case of a pedometer and the like is not applicable to a device worn at an ear such as a hearing aid. On the basis of an occurrence pattern of wind noise when walking, the walking state of the user is identified in the case where pulse-like wind noise occurs repeatedly. This enables walking detection to be performed using an existing structure, with there being no need to provide a sensor or the like. Hence, it is possible to provide a hearing aid that can be safely used even outdoors.

11 Claims, 11 Drawing Sheets

HEARING AID, HEARING AID SYSTEM, WALKING DETECTION METHOD, AND HEARING AID METHOD

TECHNICAL FIELD

The present invention relates to a hearing aid that has a function of detecting walking.

BACKGROUND ART

A hearing aid is a system used by a hearing-impaired person, a person with failing hearing, and the like to compensate for hearing. The hearing aid converts an external acoustic signal to an electric signal by a microphone, amplifies a level of the electric signal, converts the amplified electric signal to an acoustic signal again by a receiver like an earphone, and outputs the acoustic signal as audible sound that can be heard by the user.

The acoustic signal acquired by the microphone includes not only sound information necessary for the user such as conversational speech, television or radio output sound, and an intercom or telephone ring, but also various undesired sound, such as daily life noise and environmental noise, that interferes with recognition of the sound information necessary for the user. In view of this, various techniques of combining amplification and attenuation to ease the user's hearing have been devised for the hearing aid, including nonlinear amplification processing of amplifying low-level sound and not amplifying high-level sound.

In particular, a digital hearing aid that converts an acoustic signal acquired by a microphone to a digital signal and performs hearing aid processing by digital signal processing is provided in recent years. For example, there is provided a hearing aid that performs advanced noise suppression processing by dividing a acquired signal into a plurality of bands, discriminating between a desired signal and an undesired signal (for example, speech and non-speech) for each band at high speed, and extracting only the desired signal (for example, a speech signal). There is also provided a hearing aid that has a function such as directional sound acquisition of extracting only an acoustic signal coming from the front by using an input time difference between microphones placed at two positions in front and back of the hearing aid. There is further provided a hearing aid that has an internal storage area storing a plurality of hearing aid algorithms, and switches between a plurality of hearing aid processing automatically or manually by the user according to a surrounding environment of the user.

There are conventionally a number of proposals for the concept of switching between a plurality of hearing aid processing according to the surrounding environment of the user. For instance, a hearing aid having a structure shown in FIG. 1 analyzes the surrounding environment by applying a HMM (Hidden Markov Model) to the input acoustic signal to thereby identify/classify the surrounding environment as a predefined scene, and switches to a hearing aid algorithm corresponding to the predefined scene (for example, see Patent Literature 1). Moreover, a hearing aid having a structure shown in FIG. 2 analyzes constancy of ambient noise, and either switches between directional processing and noise suppression processing that employs spectral subtraction or simultaneously activates both processing, thereby improving speech clarity according to ambient noise quality (for example, see Patent Literature 2).

A conventional hearing aid 1001 shown in FIG. 1 is a type of hearing aid that performs hearing aid processing in a hearing aid processing unit 1003 for an acoustic signal acquired by a microphone 1002, and outputs the processed acoustic signal from a receiver 1004. In the hearing aid 1001, a signal analysis unit 1005 extracts acoustic features from the acoustic signal, and a signal identification unit 1006 identifies an instantaneous acoustic environmental situation. The hearing aid processing unit 1003 switches between a plurality of hearing aid algorithms according to the acoustic environmental situation identified by the signal identification unit 1006. The identification of the instantaneous acoustic environmental situation by the signal identification unit 1006 is conducted on the basis of a combination of hearing-based features such as a sound intensity, a spectral pattern, and a harmonic structure extracted by the signal analysis unit 1005, with the HMM being employed as an identification algorithm. The HMM is a statistical approach widely used in speech recognition and the like, and is a probabilistic model that estimates an output state for an unknown input, from an occurrence probability distribution in each state and previous state transitions. To apply the HMM, a training device 1007 for appropriately initializing a parameter so as not to fall into a local optimum is needed.

A conventional hearing aid 2001 shown in FIG. 2 is a type of hearing aid that performs hearing aid processing on an acoustic signal acquired by a plurality of microphones 2002*a* and 2002*b* in a hearing aid processing unit 2003, and outputs the processed acoustic signal from a receiver 2004. In the hearing aid 2001, a signal analysis unit 2005 calculates a signal level and constancy of the input acoustic signal acquired by the microphones 2002*a* and 2002*b*. The hearing aid processing unit 2003 either switches between directional processing and noise suppression processing that employs spectral subtraction or simultaneously activates both processing, according to the constancy of the input acoustic signal calculated by the signal analysis unit 2005. The hearing aid processing unit 2003 also switches between input-output characteristics tables of nonlinear processing, according to the signal level of the input acoustic signal calculated by the signal analysis unit 2005. This makes it possible to perform hearing aid processing only on a speech component after removing a noise component included in the input acoustic signal. Spectral subtraction mentioned here is a technique of subtracting an estimated noise component from an input signal in a frequency domain, and is a noise suppression method with an excellent capability of removing constant noise such as fan noise and background noise.

CITATION LIST

Patent Literature

[PTL 1]
Japanese Unexamined Patent Application Publication No. 2004-500592
[PTL 2]
Japanese Patent No. 3894875

SUMMARY OF INVENTION

Technical Problem

However, the conventional hearing aids described above extract the feature or the change of ambient noise and switch between the hearing aid algorithms, and so have a problem that processing different from required or appropriate processing is selected in some cases. Particularly on a street filled with various kinds of noise, required hearing aid processing differs depending on a hearing aid usage scene even in the same surrounding acoustic environment, and so it is not adequate to simply switch between the hearing aid algorithms in a uniform manner. For instance, when directional processing is performed during walking on a street on the ground that the user's surroundings are noisy, the user becomes more vulnerable to danger because he/she cannot notice danger approaching from the surroundings. Nevertheless, the conventional hearing aids switch to hearing aid processing such as directional processing or noise suppression processing when the surrounding acoustic environment is noisy.

That is, when automatically switching between a plurality of hearing aid processing, it is important to not only identify the surrounding environment of the user of the hearing aid, but also take the usage scene into consideration. Typical usage scenes of the hearing aid include a conversation scene, a television or radio viewing scene, a walking (outdoor) scene, and so on.

The conversation scene is probably a leading factor for a hearing-impaired person to use a hearing aid. Conventionally, a function of determining the conversation scene by detecting a speech component included in an input acoustic signal and performing hearing aid processing only on a speech signal has been widely studied as a main feature of a hearing aid. Moreover, regarding the television or radio viewing scene, television or radio output sound can be detected relatively easily through feature analysis of the input acoustic signal, and there is provided a hearing aid that performs hearing aid processing only on television or radio output sound on the basis of such detection. Besides, in recent years there is also a system that connects a hearing aid directly to a television terminal via an external device such as a remote control, enabling the user to hear television output sound more easily.

On the other hand, there has conventionally been little consideration on the walking scene such as when outdoors. When compared with the conversation scene or the viewing scene at home, the outdoor scene is filled with various kinds of noise. This being so, a conventional hearing aid switches to such hearing aid processing that removes a noise component other than conversational speech by noise suppression processing or extracts only a specific acoustic signal, e.g., an acoustic signal coming from the front, by directional processing. In the outdoor scene, however, when sound such as an alert that warns of danger or noise of a car approaching from behind is removed by noise suppression processing or directional processing while the user is not in conversation but is walking on a street, the user is put in an extremely dangerous situation. Hence, a system capable of determining, in the outdoor scene, whether the user is in conversation or walking and performing appropriate hearing aid processing according to the usage scene is necessary.

As one of the outdoor usage scenes, the walking scene of the outdoor usage scenes can be determined by detecting the user's walking. Walking detection using a vibration or acceleration sensor is typically employed to detect such a walking state of the user. However, in the case where the sensor is mounted in a hearing aid that is worn at an ear, there are problems such as false detection when the user shakes his/her head or the like, and increases in size and cost of the hearing aid due to the mounted sensor. Though the user may manually switch between a plurality of hearing aid processing during walking through a remote control of the hearing aid or a switch provided on the body of the hearing aid, it is more desirable to automatically switch between the plurality of hearing aid processing for reasons such as the following (1) and (2): (1) the walking scene can take place daily and frequently; and (2) it is preferable that the user is unaware of his/her use of the hearing aid as much as possible.

To solve these problems, the present invention has an object of providing an adaptive hearing aid that detects the walking state of the user and automatically switches between a plurality of hearing aid processing according to the user's moving state and surrounding environment.

Solution to Problem

To solve the conventional problems stated above, a hearing aid according to the present invention is a hearing aid including: a sound acquisition unit that acquires an external acoustic signal; a hearing aid processing unit that switches between a plurality of algorithms to perform hearing aid processing on the acquired acoustic signal; and an output unit that outputs the acoustic signal on which the hearing aid processing has been performed, the hearing aid including: a wind noise detection unit that detects wind noise that is mixed in the acquired acoustic signal during the acquisition; and a time variation detection unit that detects a time variation of the detected wind noise, wherein the hearing aid processing unit switches between the plurality of algorithms to perform the hearing aid processing on the acquired acoustic signal, on the basis of the detected time variation of the wind noise.

With this structure, the hearing aid according to the present invention can detect the walking state of the user of the hearing aid from wind noise that is affected by the walking state of the user, and automatically switch to hearing aid processing suitable for the state of the user.

Moreover, the time variation detection unit in the hearing aid according to the present invention may include: a pulse detection unit that detects a pulse-like variation of the wind noise, as a variation of the wind noise; and a repetition detection unit that detects whether or not the detected pulse-like variation repeats with time.

With this structure, the hearing aid according to the present invention can detect whether or not wind noise occurs synchronously with the user's walking, thereby detecting the walking state of the user.

Moreover, the sound acquisition unit in the hearing aid according to the present invention may include a first microphone and a second microphone, wherein the wind noise detection unit includes a coefficient variable filter unit that updates, using an acoustic signal acquired by the first microphone as a main signal and an acoustic signal acquired by the second microphone as a reference signal, a filter coefficient so as to minimize a difference between an estimation signal and the reference signal, the estimation signal being obtained by filtering the main signal, and the wind noise detection unit detects, as the wind noise, an error signal indicating a difference between the estimation signal and the reference signal.

With this structure, the hearing aid according to the present invention can detect wind noise included in the acquired acoustic signal more accurately, and as a result detect the walking state of the user more accurately on the basis of the detected wind noise.

Moreover, the sound acquisition unit in the hearing aid according to the present invention may include a first microphone and a second microphone, wherein the wind noise detection unit includes a coefficient variable filter unit that updates, using an acoustic signal acquired by the first microphone as a main signal and an acoustic signal acquired by the second microphone as a reference signal, a filter coefficient so as to minimize a difference between an estimation signal and the reference signal, the estimation signal being obtained by filtering the main signal, and the wind noise detection unit detects, as the wind noise, the filter coefficient.

With this structure, the hearing aid according to the present invention can detect an occurrence state of wind noise included in the acquired acoustic signal more accurately, and as a result detect the is walking state of the user more accurately on the basis of the detected occurrence state.

Moreover, the pulse detection unit in the hearing aid according to the present invention may include: a variation component extraction unit that extracts a variation component of the filter coefficient; and a gain control unit that controls a gain of the variation component on the basis of a smoothing level of the extracted variation component, wherein the pulse detection unit detects a pulse-like variation of the filter coefficient, on the basis of a level of the gain-controlled variation component.

With this structure, the hearing aid according to the present invention can detect a change section of wind noise occurrence included in the acquired acoustic signal more accurately, and as a result detect the walking state of the user more accurately on the basis of the detected change section.

Moreover, the gain control unit in the hearing aid according to the present invention controls the gain of the variation component, on the basis of a duration for which the smoothing level of the variation component exceeds a predetermined threshold.

With this structure, the hearing aid according to the present invention can respond to wind noise that changes according to a walking speed of the user, with it being possible to detect the walking state of the user even when the walking speed of the user changes.

Moreover, the hearing aid according to the present invention may further include: a directionality synthesis unit that generates a directional signal having directional sensitivity in a first direction and an omnidirectional signal having no directional sensitivity in a specific direction, using the acoustic signal acquired by the first microphone and the acoustic signal acquired by the second microphone; and a directionality control unit that is capable of switching an output of the directionality synthesis unit between the directional signal and the omnidirectional signal, wherein the directionality control unit switches the output of the directionality synthesis unit to the directional signal in the case where the repetition detection unit does not detect that the pulse-like variation repeats with time, and to the omnidirectional signal in the case where the repetition detection unit detects that the pulse-like variation repeats with time.

With this structure, the hearing aid according to the present invention can automatically change how ambient sound is heard, depending on the walking state of the user.

Moreover, the hearing aid according to the present invention may be worn at one ear of a user, and further include a transmission and reception unit that transmits the time variation of the wind noise detected by the time variation detection unit to another hearing aid worn at an other ear of the user, and receives a time variation of wind noise detected by the other hearing aid, wherein the hearing aid processing unit switches between the plurality of algorithms to perform the hearing aid processing on the acquired acoustic signal, on the basis of the time variation of the wind noise detected by the time variation detection unit and the time variation of the wind noise received by the transmission and reception unit.

With this structure, the hearing aid according to the present invention can share wind noise detection between the hearing aids worn at both ears, so that the walking state of the user can be detected more accurately. In addition, the hearing aid switches between the plurality of hearing aid processing according to the wind noise detection results of the hearing aids at both ears, with it being possible to perform hearing aid processing more suitable for the state of the user.

A hearing aid system according to the present invention is a hearing aid system including a pair of hearing aids described above, wherein each of the hearing aids further includes a transmission and reception unit that transmits the time variation of the wind noise detected by the time variation detection unit to an other one of the hearing aids, and receive a time variation of wind noise detected by the other hearing aid, and the hearing aid processing unit switches between the plurality of algorithms to perform the hearing aid processing on the acquired acoustic signal, on the basis of the time variation of the wind noise detected by the time variation detection unit and the time variation of the wind noise received by the transmission and reception unit.

With this structure, the hearing aid system according to the present invention can share wind noise detection between the hearing aids worn at both ears, so that the walking state of the user can be detected more accurately.

A walking detection method according to the present invention includes: acquiring an external acoustic signal; detecting wind noise that is mixed in the acquired acoustic signal during the acquisition; detecting a time variation of the detected wind noise; and determining that a user is in a walking state, in the case where the detected time variation of the wind noise is a repetitive pulse-like variation.

With this structure, the walking detection method according to the present invention can detect the walking state.

Note that the present invention can be realized not only as a device, but also as a method including steps corresponding to processing units of the device, a program causing a computer to execute the steps, a computer-readable recording medium such as a CD-ROM on which the program is recorded, and information, data, or a signal indicating the program. Such a program, information, data, or signal may be distributed via a communication network such as the Internet.

Advantageous Effects of Invention

According to the present invention, it is possible to provide an adaptive hearing aid that can easily detect the walking state of the user of the hearing aid and automatically switch to hearing aid processing suitable for the walking scene which is a typical usage scene of the hearing aid.

DESCRIPTION OF EMBODIMENTS

The following describes embodiments of the present invention with reference to drawings.

Embodiment 1

Figure 1:
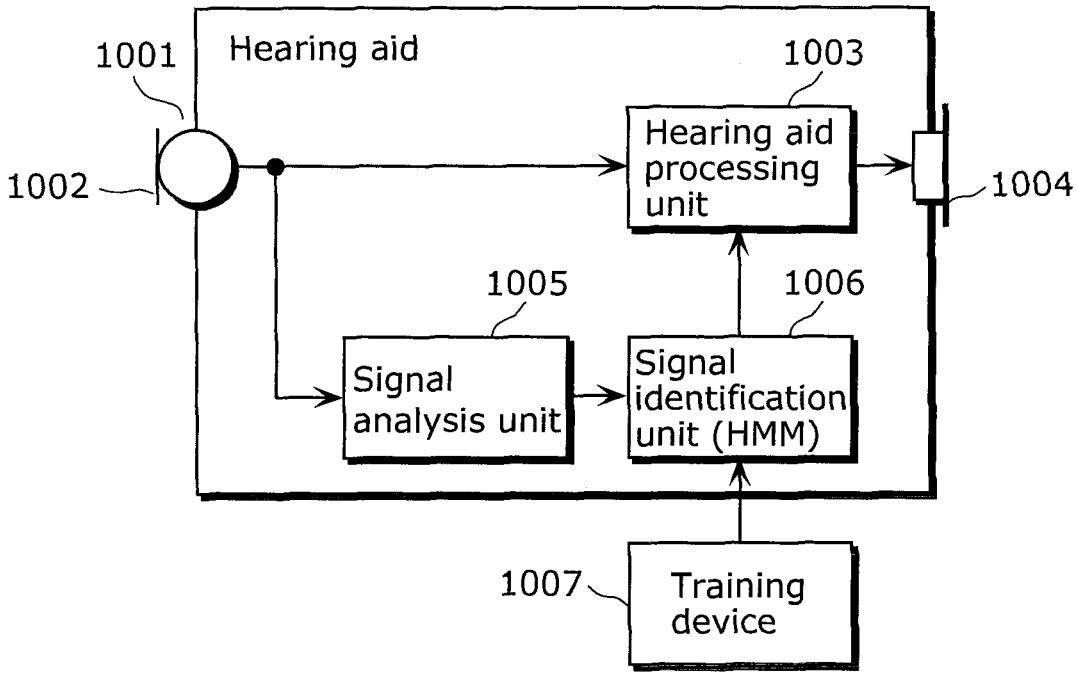
FIG. 1 is a block diagram showing a structure of a conventional hearing aid described in Literature 1.
Figure 2:
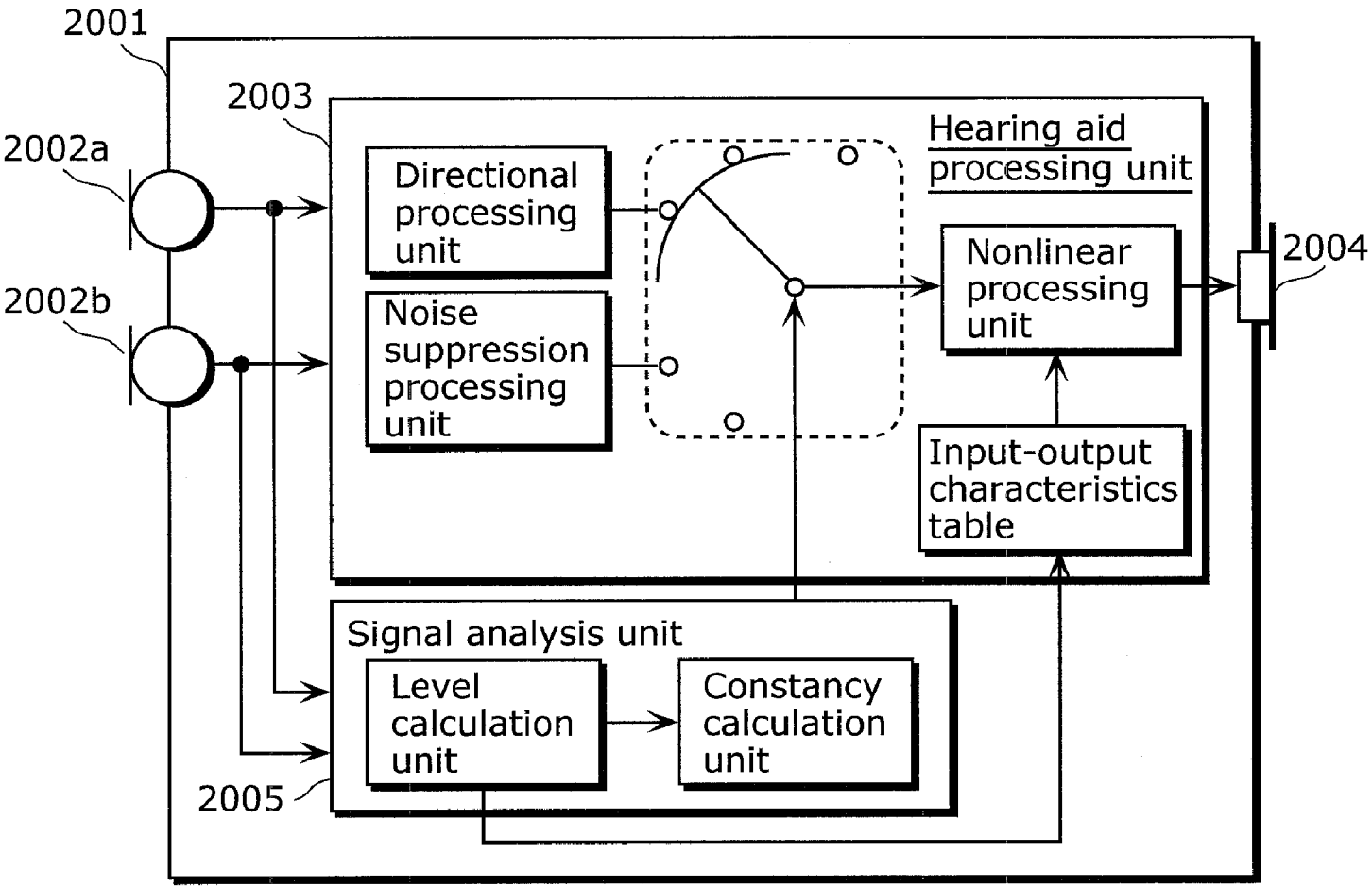
FIG. 2 is a block diagram showing a structure of a conventional hearing aid described in Literature 2.
Figure 3:
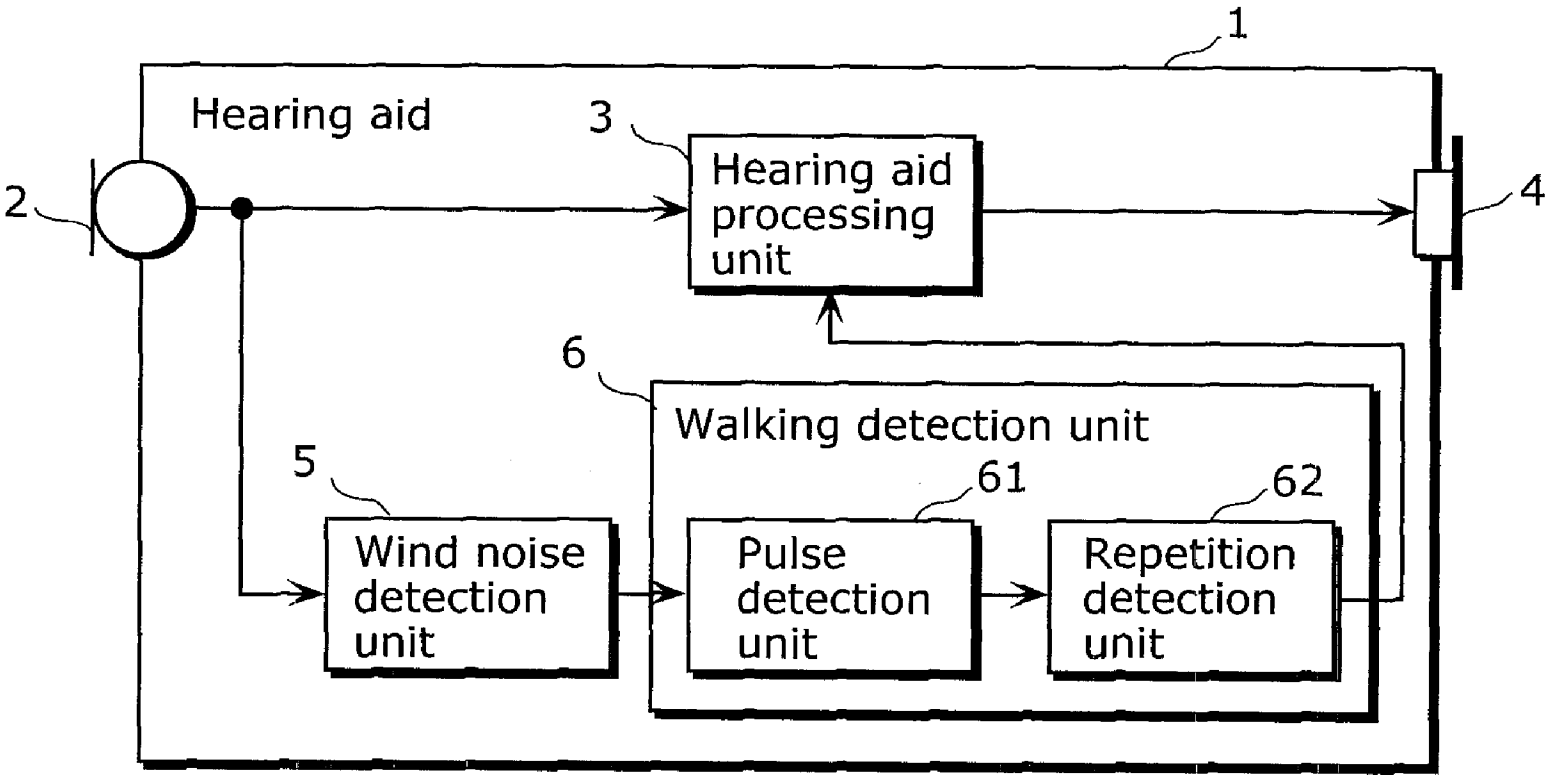
FIG. 3 is a block diagram showing a basic structure of a hearing aid in Embodiments 1 to 4 of the present invention.
Figure 5:
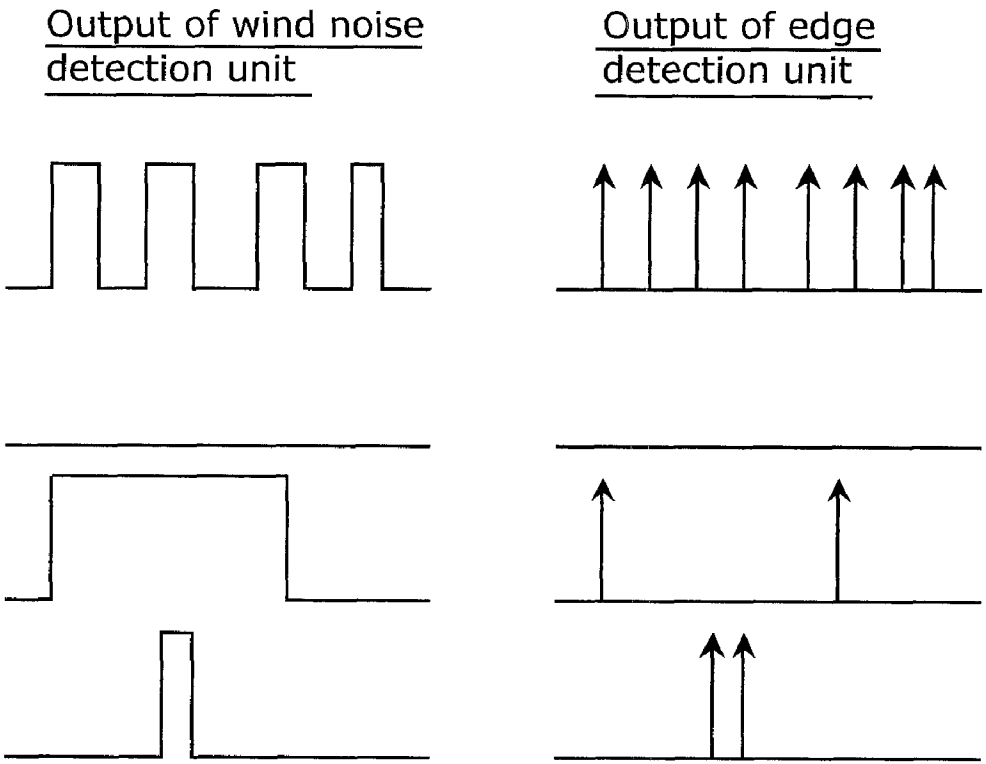
FIG. 5 is a diagram showing a relation between an output of a wind noise detection unit and an output of an edge detection unit shown in FIG. 4.

The following describes a structure and an operation of a hearing aid 1 in Embodiment 1, with reference to FIGS. 3 and 5.

The hearing aid 1 in this embodiment includes a microphone 2, a hearing aid processing unit 3, a receiver 4, a wind noise detection unit 5, and a walking detection unit 6. The walking detection unit 6 includes a pulse detection unit 61 and a repetition detection unit 62.

The microphone 2 acquires an external acoustic signal into the hearing aid 1.

The hearing aid processing unit 3 performs hearing aid processing such as amplification or attenuation on the acoustic signal acquired by the microphone 2, according to a hearing level and the like of the user, and outputs the acoustic signal on which the hearing aid processing has been performed to the receiver 4.

The receiver 4 outputs the acoustic signal on which the hearing aid processing has been performed to outside again, so as to be heard by the user.

The wind noise detection unit 5 detects a level of wind noise that is mixed in the acoustic signal acquired by the microphone 2 during sound acquisition, and outputs the detected level to the walking detection unit 6 as a wind noise occurrence signal.

The pulse detection unit 61 in the walking detection unit 6 extracts a pulse-like variation of the wind noise occurrence signal, and outputs information of the pulse-like variation to the repetition detection unit 62.

The repetition detection unit 62 in the walking detection unit 6 detects a time repetition of the pulse-like variation of the wind noise occurrence signal, thereby detecting the walking state of the user. The repetition detection unit 62 outputs a walking detection signal to the hearing aid processing unit 3.

The hearing aid processing unit 3 switches between a plurality of hearing aid algorithms according to the walking state detected by the walking detection unit 6.

There are many scenes in which wind noise is large enough to be at an annoying level, including not only a situation where the user stays outdoors when wind is actually blowing, but also a situation where the user is riding a bicycle, a situation where the user is near an air conditioner, a situation where the user is in a passage or the like with swirling wind, and so on. Though not at the annoying level, wind noise still occurs even when the user is just normally walking. Such wind noise, though at a low level, occurs instantaneously and periodically in synchronization with the user's walking (see FIG. 5(*a*)). In the user's daily life, there is little possibility that such instantaneous wind noise occurs repeatedly, except when walking. Wind noise does not occur when the user is stationary and wind is not blowing (see FIG. 5(*b*)), and wind noise that continues to a certain extent occurs when the user is stationary and wind is blowing (see FIG. 5(*c*)). Meanwhile, wind noise occurs instantaneously but not repeatedly, when wind is generated instantaneously by opening or closing a door and the like (see FIG. 5(*d*)). Therefore, the walking detection unit 6 can detect the walking state of the user, by detecting the state where instantaneous wind noise occurs repeatedly.

Figure 4:
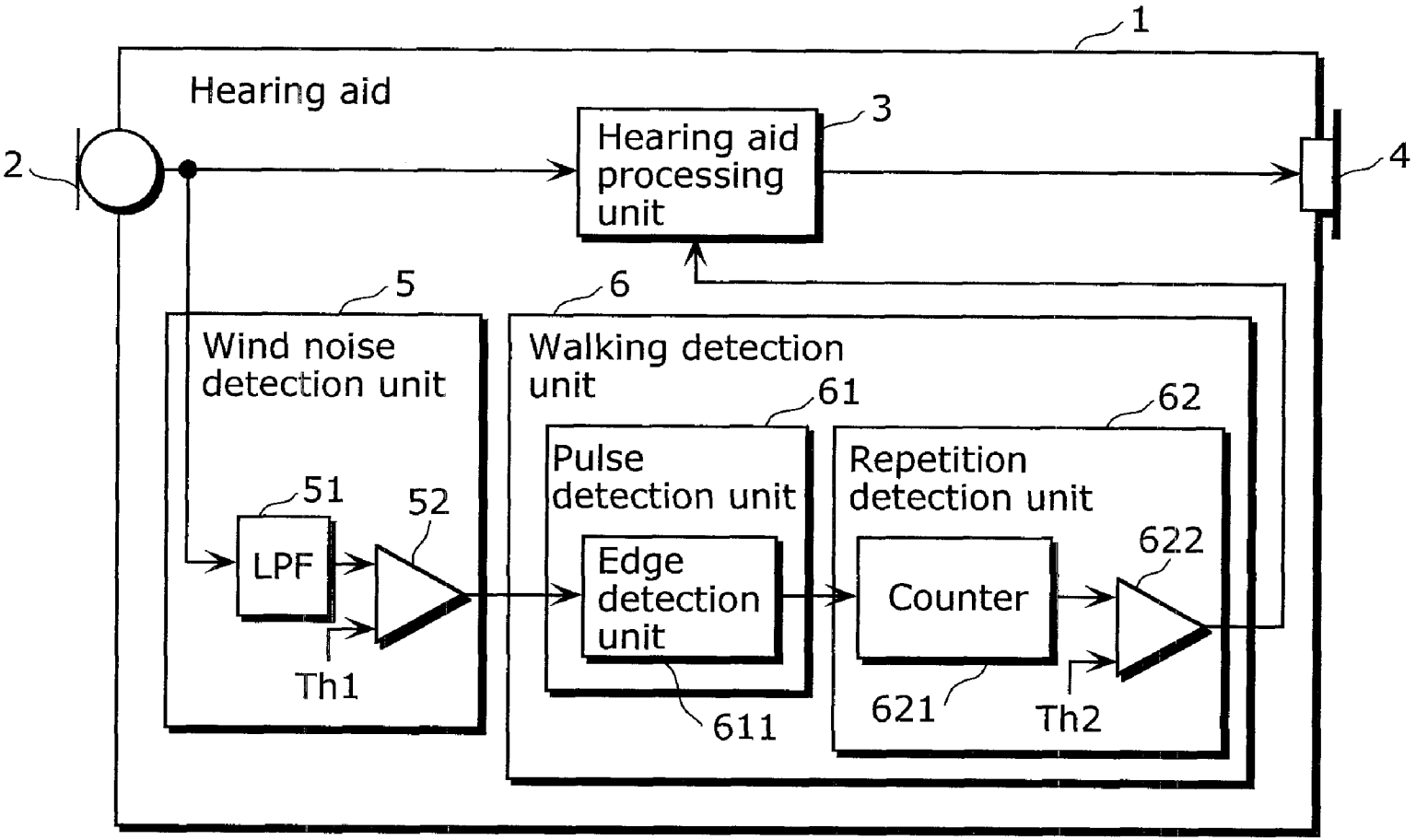
FIG. 4 is a block diagram showing a detailed structure of a hearing aid in Embodiment 1 of the present invention.
Figure 9:
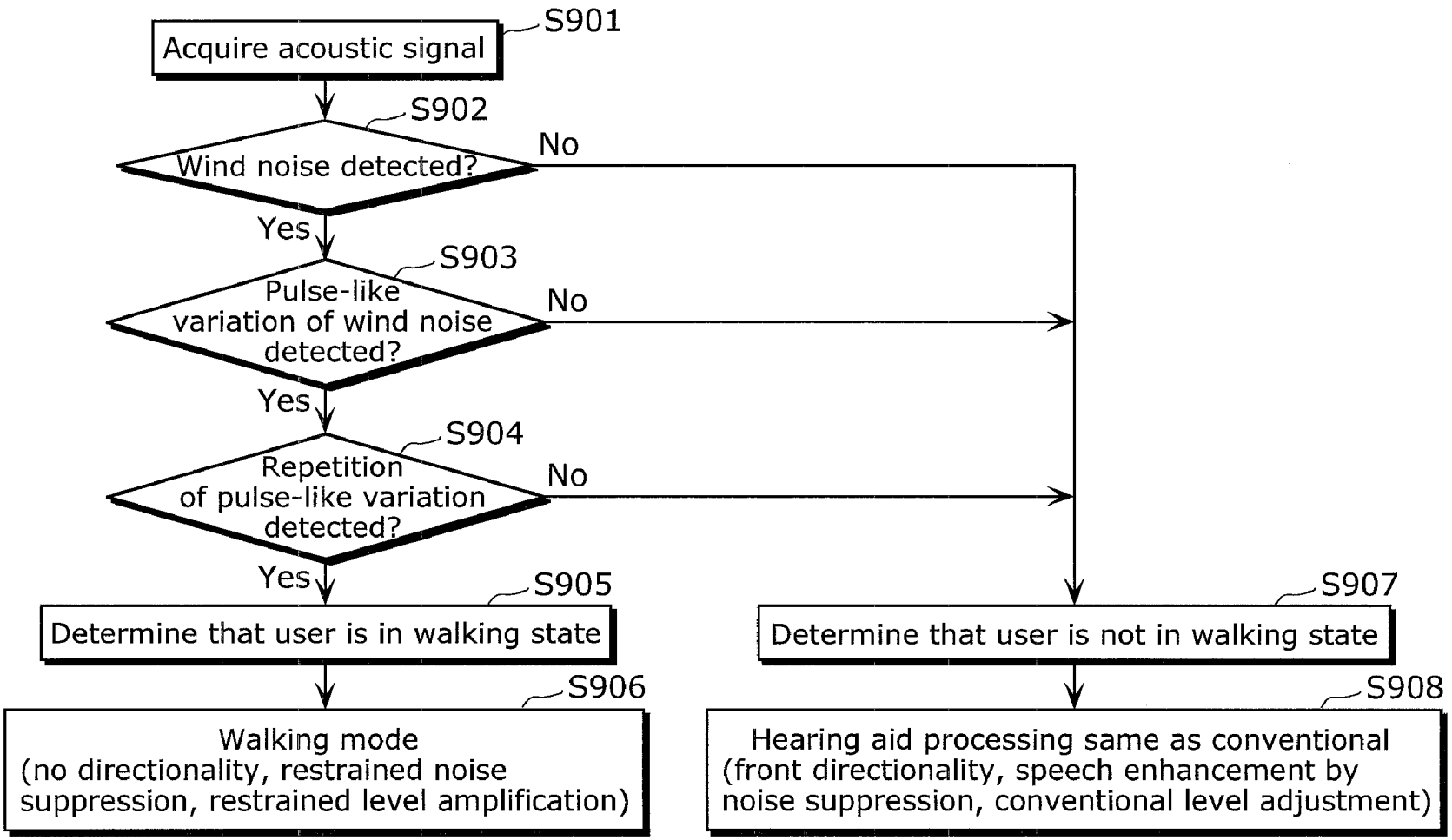
FIG. 9 is a flowchart showing a walking detection method in Embodiments 1 and 2 of the present invention.

The following describes structures and operations of the wind noise detection unit 5 and the walking detection unit 6 in detail, with reference to FIGS. 4 and 9.

The wind noise detection unit 5 includes a low-pass filter (LPF) 51 and a comparator 52.

The pulse detection unit 61 in the walking detection unit 6 includes an edge detection unit 611. The repetition detection unit 62 in the walking detection unit 6 includes a counter 621 and a comparator 622.

In the case where wind noise is included in the acoustic signal acquired by the microphone 2, a frequency component of the input acoustic signal concentrates in a low frequency band, when compared with the case where only a speech component is included in the acoustic signal. On the basis of this feature, the acoustic signal acquired by the microphone 2 is inputted to the low-pass filter 51 to extract a low frequency component. It is known by experiment that a wind noise component mainly occurs at equal to or less than 1 kHz. Accordingly, a cutoff frequency of the low-pass filter may be set to about 1 kHz. Note that similar advantageous effects can be expected even when using a higher cutoff frequency or a lower cutoff frequency to extract a more prominent feature quantity of wind noise. Moreover, a band-pass filter that extracts the low frequency component after removing a DC component may be used instead of the low-pass filter. Furthermore, similar advantageous effects can be achieved even with a structure of extracting only the low frequency component using a frequency analyzer (FFT). The wind noise detection unit 6 compares a level of the extracted low frequency component with a predetermined threshold (Th1), in the comparator 52. In the case where the level of the low frequency component is equal to or more than the threshold, the wind noise detection unit 5 determines that wind noise occurs. In the case where the level of the low frequency component is less than the threshold, the wind noise detection unit 5 determines that wind noise does not occur. Note that the predetermined threshold (Th1) may be experimentally determined to a value that allows a wind noise occurrence to be detected, while generating winds of various levels and durations. In detail, since a typical walking speed of a person is about 4 km/h, that is, about 1 m/s, which is approximately equal to a speed of a natural breeze, the predetermined threshold (Th1) may be set to a value that allows wind noise of about 1 m/s to be detected. The predetermined threshold (Th1) may be fixed. Alternatively, the predetermined threshold (Th1) may be variable in such a manner that changes when wind noise continues for a certain time or more.

Thus, the wind noise detection unit 5 detects the wind noise occurrence (Step S902), and outputs a wind noise occurrence signal to the walking detection unit 6. Here, the wind noise occurrence signal is a flag signal that is Low in a time section during which wind noise is not detected, and High in a time section during which wind noise is detected, as shown in FIG. 5.

The edge detection unit 611 in the pulse detection unit 61 in the walking detection unit 6 detects a transition of the wind noise occurrence signal from Low to High, a transition of the wind noise occurrence signal from High to Low, or both of the transitions. By doing so, the edge detection unit 611 detects a change of wind noise occurrence, and outputs information about a timing of the change to the repetition detection unit 62

(Step S903). The repetition detection unit 62 counts the number of changes of wind noise occurrence within a predetermined time, in the counter 621. The repetition detection unit 62 then compares the counted number of changes of wind noise occurrence with a predetermined threshold (Th2), in the comparator 622 (Step S904). In the case where the number of changes of wind noise occurrence is equal to or more than the threshold, the repetition detection unit 62 determines that the user is in the walking state (Step S905). In the case where the number of changes of wind noise occurrence is less than the threshold, the repetition detection unit 62 determines that the user is not in the walking state (Step S907). A large number of changes of wind noise occurrence within the predetermined time means that a frequency of change of wind noise occurrence is high, i.e., a duration of one wind noise occurrence is short. In such a case, instantaneous wind noise occurs repeatedly (see FIG. 5(*a*)), and so it can be determined that the user is in the walking state. On the other hand, a small number of changes of wind noise occurrence corresponds to any of the following cases (1) to (3): (1) wind noise does not occur (see FIG. 5(*b*)); (2) a duration of one wind noise occurrence is long (see FIG. 5(*c*)); and (3) a duration of one wind noise occurrence is short but wind noise does not occur repeatedly (see FIG. 5(*d*)). In these cases, it can be determined that the user is not in the walking state. Hence, the walking detection unit 6 can detect the walking state of the user, by detecting the time repetition of the pulse-like variation of the wind noise occurrence signal. Note that the predetermined threshold (Th2) may be experimentally determined to a value that allows wind noise in the walking state to be distinguished from normal wind noise. In detail, since a pace when walking relatively slowly with no particular purpose is about 100 to 110 steps per minute, the predetermined threshold (Th2) may be set to a value in accordance with this number of steps. The predetermined threshold (Th2) may be fixed. Alternatively, the predetermined threshold (Th2) may be variable in such a manner that changes depending on the surrounding environmental situation.

Thus, the walking detection unit 6 detects the walking state of the user, and outputs a walking detection signal to the hearing aid processing unit 3. Here, the walking detection signal is a flag signal that is Low in a time section during which the walking state of the user is not detected, and High in a time section during which the walking state is detected.

The hearing aid processing unit 3 switches between a plurality of hearing aid algorithms according to the walking detection signal. In the case where the walking state is not detected, the hearing aid processing unit 3 switches between the hearing aid algorithms according to a normal surrounding acoustic environment. In the case where the walking state is detected, the hearing aid processing unit 3 executes hearing aid processing in a walking mode that is different from the normal hearing aid algorithm switching.

For the sake of simplicity, it is assumed here that the hearing aid processing unit 3 performs the normal hearing aid algorithm switching as follows. In the normal switching, the hearing aid processing unit 3 compares the input acoustic signal level with a predetermined threshold. In the case where the signal level is less than the threshold, the hearing aid processing unit 3 determines that the user is in a quiet environment such as indoors, and performs hearing aid processing on the input acoustic signal without applying noise suppression processing. In the case where the signal level is equal to or more than the threshold, on the other hand, the hearing aid processing unit 3 determines that the user is in a noisy environment such as outdoors, and applies noise suppression processing to perform hearing aid processing only on a speech component included in the input acoustic signal.

In the case where the walking detection signal shows that the user is not in the walking state, the hearing aid processing unit 3 switches to a hearing aid algorithm according to the input acoustic signal level. The hearing aid processing unit 3 performs noise suppression processing when the signal level is equal to or more than the predetermined threshold, and does not perform noise suppression processing when the signal level is less than the threshold (Step S908). In the case where the walking detection signal shows that the user is in the walking state, on the other hand, the hearing aid processing unit 3 does not perform the hearing aid algorithm switching according to the input acoustic signal level as has been conventionally done. For example, even when the signal level is equal to or more than the predetermined threshold, the hearing aid processing unit 3 does not perform noise suppression processing, and instead reduces the amount of amplification in hearing aid processing (Step S906). That is, in the case where the walking state is not detected, the hearing aid processing unit 3 switches to a hearing aid algorithm according to the input acoustic signal level. For example, in a noisy environment, the hearing aid processing unit 3 removes a noise component included in the acoustic signal, thereby alleviating a noisy, unpleasant condition. In the case where the walking state is detected, even in a noisy environment, the hearing aid processing unit 3 performs hearing aid processing without removing a signal other than a speech component from the input acoustic signal by noise suppression processing. As a result, when there is sound of danger other than a speech signal, the user can hear the sound of danger.

As described above, by detecting whether or not the user is in the walking state from wind noise included in the surrounding acoustic signal and switching between a plurality of hearing aid algorithms according to the walking state, more favorable hearing aid processing desired by the user can be provided.

A recent hearing aid is provided with a function of recording a usage state of the user and utilizing the usage state as auxiliary information for subsequent use or fitting. One example of such a function is a function of recording volume control information of the user and setting an initial volume upon next use. By recording the walking state of the user through the use of this function, a usage scene of the user can be estimated. In detail, in the case where the walking state is frequently recorded, it is estimated that the user frequently walks or goes outside. In such a case, for instance, by readjusting the threshold and the like so that the walking state is detected more, hearing aid processing more suitable for the usage scene of the user can be achieved. Meanwhile, in the case where the frequency of detecting the walking state differs according to the time of day, the threshold may be changed so that the walking state is detected more only during the time of day when the walking state is frequently detected.

Though this embodiment describes the hearing aid, the same structure is applicable to other acoustic equipment. For example, using a microphone (which may be either an existing microphone or a newly added microphone) of an earphone, a headphone, or a portable music player, especially a music player with a noise cancelling function, wind noise is detected to thereby detect the walking state, in the same way as above. In the case where the walking state is not detected, only a reproduced music signal is outputted from the earphone. In the case where the walking state is detected, ambient sound is mixed in the reproduced music signal to such an extent that does not interfere with music, and outputted from the earphone.

Embodiment 2

Figure 6:
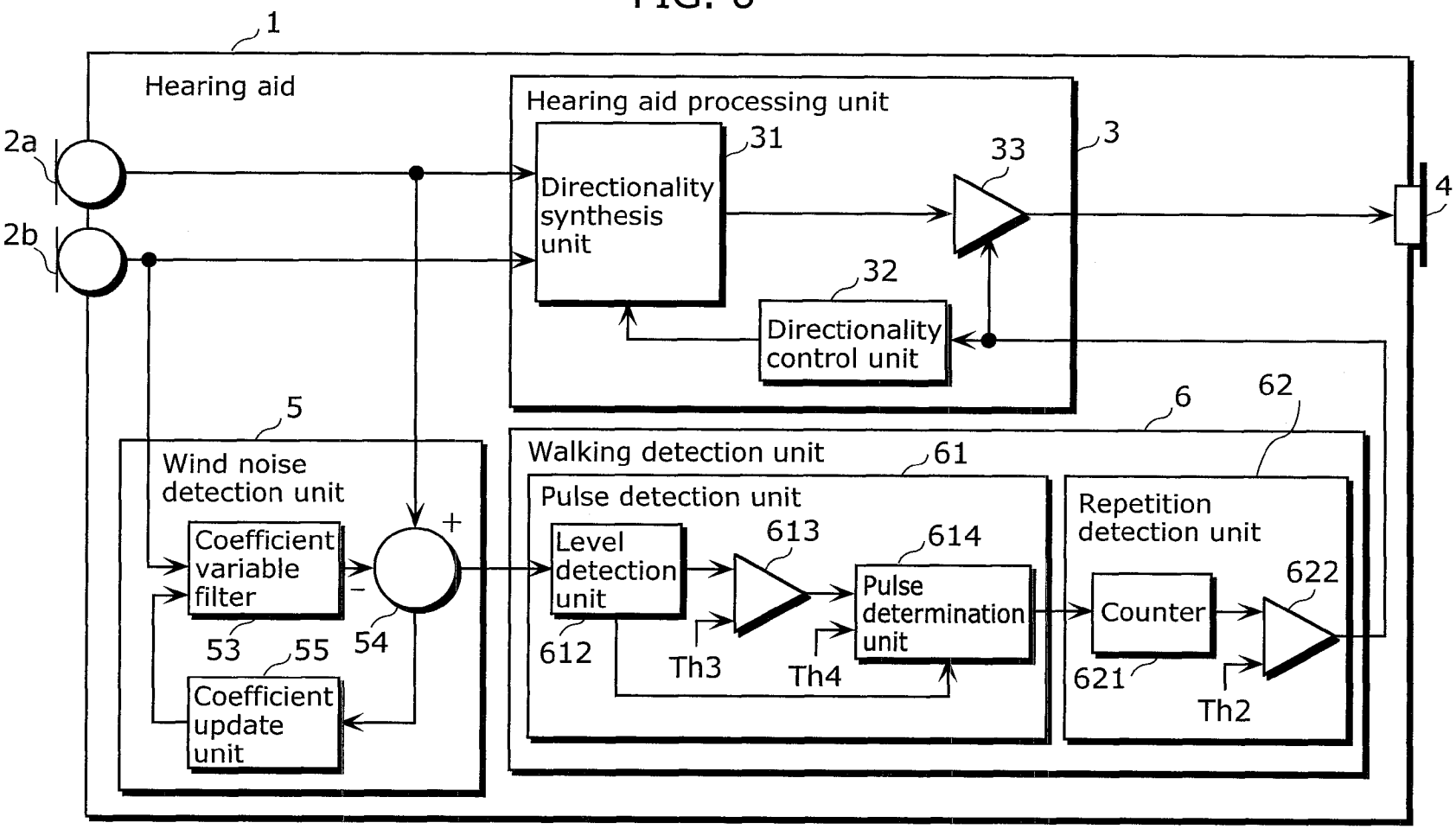
FIG. 6 is a block diagram showing a detailed structure of a hearing aid in Embodiment 2 of the present invention.

The following describes a structure and an operation of the hearing aid 1 in Embodiment 2, with reference to FIGS. 6 and 9.

The hearing aid 1 in this embodiment includes the microphone 2 that includes microphones 2*a* and 2*b*. In the following, description of the same components as those in the hearing aid 1 in Embodiment 1 is omitted, and the wind noise detection unit 5 and the pulse detection unit 61 in the walking detection unit 6 in this embodiment are described in detail.

The wind noise detection unit 5 in this embodiment includes an adaptive filter that uses one of acoustic signals acquired by the microphones 2*a* and 2*b* as a main signal, and the other one of the acoustic signals as a reference signal. In detail, the wind noise detection unit 5 includes a coefficient variable filter 53, a subtractor 54, and a coefficient update unit 55.

The pulse detection unit 61 in the walking detection unit 6 includes a level detection unit 612, a comparator 613, and a pulse determination unit 614.

The adaptive filter in the wind noise detection unit 5 is described first. In the wind noise detection unit 5 in Embodiment 1, a wind noise occurrence is detected on the basis of the feature that, when wind noise is included in the acoustic signal acquired by the microphone 2, the frequency component of the input acoustic signal concentrates in the low frequency band. Apart from this feature, there is the following feature of wind noise. Since wind noise is caused by turbulent airflow around an input port of a microphone, wind noise mixed in acoustic signals acquired by a plurality of microphones during sound acquisition has no correlation with each other. On the basis of this feature, a wind noise occurrence is detected from a degree of convergence and divergence of the adaptive filter that uses the acoustic signals acquired by the microphones 2*a* and 2*b* respectively as the reference signal and the main signal.

The coefficient variable filter 53 receives the main signal which is the acoustic signal acquired by the microphone 2*b*, filters the main signal using a filter coefficient from the coefficient update unit 55, and outputs an estimation signal. The subtractor 54 calculates a difference between the estimation signal and the reference signal acquired by the microphone 2*a*, and outputs the calculated difference as an error signal. The coefficient update unit 55 adaptively updates the filter coefficient of the coefficient variable filter 53 so as to minimize the error signal calculated by the subtractor 54.

In the case where only a speech component is included in the acoustic signals acquired by the microphones 2*a* and 2*b*, the two input acoustic signals are approximately identical signals merely with a delay corresponding to a distance between the microphones. This being so, the adaptive filter using the acoustic signal acquired by the microphone 2*b* as the main signal and the acoustic signal acquired by the microphone 2*a* as the reference signal converges, as a result of which the error signal approaches 0. On the other hand, in the case where wind noise is included in the acoustic signals acquired by the microphones 2*a* and 2*b*, the two input acoustic signals are uncorrelated with each other. Accordingly, the adaptive filter does not converge but diverges, as a result of which the error signal increases.

Thus, the wind noise detection unit 5 detects the wind noise occurrence, and outputs the error signal to the walking detection unit 6 as the wind noise occurrence signal (Step S902). Here, the wind noise occurrence signal is a signal indicating a continuous amount corresponding to the amount of wind noise occurrence, and has a level that approaches 0 when wind noise does not occur, and increases when wind noise increases.

The level detection unit 612 in the pulse detection unit 61 in the walking detection unit 6 detects the level of the wind noise occurrence signal. The level detection unit 612 takes an absolute value of the wind noise occurrence signal, in its simplest structure. The level detection unit 612 may also include smoothing processing according to need. The comparator 613 compares the detected wind noise occurrence level with a predetermined threshold (Th3).

The pulse determination unit 614 compares a duration for which the wind noise occurrence level exceeds the predetermined threshold (Th3), with a predetermined duration (Th4). In the case where the duration for which the wind noise occurrence level exceeds the predetermined threshold (Th3) is equal to or less than the predetermined duration, the pulse determination unit 614 determines that the wind noise occurrence has a pulse-like property. Note that the predetermined threshold (Th3) and the predetermined duration (Th4) may be experimentally determined to values that allow wind noise in the walking state to be detected. For example, given a typical walking speed of a person and a speed of a natural breeze, the predetermined threshold (Th3) may be set to a value that allows wind noise of about 1 m/s to be detected. Moreover, since a pace when walking relatively slowly is about 100 to 110 steps per minute, the predetermined duration (Th4) may be set to about 1 second, i.e., a time required for about 1.2 steps. The predetermined threshold (Th3) and the predetermined duration (Th4) may be fixed. Alternatively, the predetermined threshold (Th3) and the predetermined duration (Th4) may be variable in such a manner that changes according to the wind noise occurrence level detected by the level detection unit 612. For instance, the pulse determination unit 614 may use different values for the predetermined threshold (Th3) and the predetermined duration (Th4) in the following way. When the walking speed is fast, the wind noise occurrence level is high, and also the wind noise occurrence has a short pulse duration. When the walking speed is slow, on the other hand, the wind noise occurrence level is low, and also the wind noise occurrence has a long pulse duration. In view of this, in the case where the wind noise occurrence level exceeds a first threshold (Th31), that is, in the case where the user is walking fast, the pulse determination unit 614 selects a first duration (Th41). In the case where the wind noise occurrence level is equal to or less than the first threshold (Th31) and exceeds a second threshold (Th32) smaller than the first threshold (Th31), that is, in the case where the user is walking slowly, the pulse determination unit 614 selects a second duration (Th42) larger than the first duration (Th41). In this way, the pulse-like property of wind noise occurrence can be detected regardless of whether the walking speed is fast or slow, with it being possible to detect the walking state. The predetermined threshold (Th3) and the predetermined duration (Th4) are not limited to the above combinations of the two values, i.e., the first and second values, and may be combinations of three or more threshold values.

Thus, the pulse detection unit 61 detects the pulse-like variation of the wind noise occurrence signal (Step S903), and outputs a pulse-like variation detection result of the wind noise occurrence signal to the repetition detection unit 62.

The repetition detection unit 62 compares the number of times the pulse-like variation of the wind noise occurrence is detected within the predetermined time, with the predetermined number (Th2). In the case where the number is equal to or more than the predetermined number, the repetition detection unit 62 determines that pulse-like wind noise occurs repeatedly, and accordingly determines that the user is in the walking state. Note that the predetermined number (Th2) may be variable in such a manner that changes according to the walking speed. For instance, the repetition detection unit 62 may use different values for the predetermined number (Th2) in the following way. When the walking speed is fast, pulse-like wind noise has a high repetition frequency. When the walking speed is slow, pulse-like wind noise has a low repetition frequency. This being so, in the case where the wind noise occurrence level exceeds the first threshold (Th31), the repetition detection unit 62 selects a first number (Th21). In the case where the wind noise occurrence level is equal to or less than the first threshold (Th31) and exceeds the second threshold (Th32) smaller than the first threshold (Th31), the repetition detection unit 62 selects a second number (Th22) that is smaller than the first number (Th21). In this way, the repetition of pulse-like wind noise occurrence can be detected regardless of whether the walking speed is fast or slow, with it being possible to detect the walking state. Moreover, in the detection of the walking state, the walking speed may be detected according to the repetition frequency of pulse-like wind noise occurrence. For example, the repetition detection unit 62 may determine that the user is walking fast in the case where the number of times the pulse-like variation of wind noise occurrence is detected within the predetermined time is equal to or more than the first number (Th21), and determines that the user is walking slowly in the is case where the number of times the pulse-like variation of wind noise occurrence is detected within the predetermined time is less than the first number (Th21) and equal to or more than the second number (Th22) smaller than the first number (Th21). The predetermined number (Th2) is not limited to the combination of the two values, i.e., the first and second values, and may be a combination of three or more threshold values to enable the walking speed to be detected in three or more stages. By detecting the time repetition of the pulse-like variation of the wind noise occurrence signal in this manner (Step S904), the repetition detection unit 62 detects the walking state of the user (Steps S905, S907).

Thus, the walking detection unit 6 detects the walking state of the user, and outputs the walking detection signal to the hearing aid processing unit 3.

The hearing aid processing unit 3 may perform hearing aid processing according to the walking detection signal in the same way as in Embodiment 1. Alternatively, the hearing aid processing unit 3 may perform the following hearing aid processing, on the basis of the fact that the microphone 2 includes the microphones 2*a* and 2*b*.

The hearing aid processing unit 3 includes a directionality synthesis unit 31 that generates a directional signal having directional sensitivity in a specific direction such as a front direction of the user of the hearing aid, and an omnidirectional signal having no directional sensitivity in the specific direction, and a directionality control unit 32 that switches the output of the directionality synthesis unit 31 between the directional signal and the omnidirectional signal. The hearing aid processing unit 3 performs processing such as amplification on the output signal of the directionality synthesis unit 31 switched by the directionality control unit 32. An amplifier 33 that is variable in amplification amount for each frequency band is shown in FIG. 6, for the sake of simplicity.

In the case where the walking state is not detected, the hearing aid processing unit 3 performs normal switching. In the normal switching, the hearing aid processing unit 3 compares the input acoustic signal level with a predetermined threshold. In the case where the signal level is less than the threshold, the hearing aid processing unit 3 determines that the user is in a quiet environment such as indoors, and switches the output of the directionality synthesis unit 31 to the omnidirectional signal and performs hearing aid processing on the omnidirectional signal. That is, the hearing aid processing unit 3 performs hearing aid processing such as amplification, on the acoustic signal coming from all directions. In the case where the signal level is equal to or more than the threshold, on the other hand, the hearing aid processing unit 3 determines that the user is in a noisy environment such as outdoors, and switches the output of the directionality synthesis unit 31 to the directional signal and performs hearing aid processing on the directional signal. That is, the hearing aid processing unit 3 performs hearing aid processing such as amplification, on the acoustic signal coming from the specific direction such as the front of the user of the hearing aid (Step S908).

In the case where the walking state is detected, even when the signal level is equal to or more than the threshold, the hearing aid processing unit 3 sets the output of the directionality synthesis unit 31 to the omnidirectional signal, and reduces the amplification amount of the amplifier 33 (Step S906).

Thus, by detecting whether or not the user is in the walking state through the use of the error signal of the adaptive filter and switching between hearing aid modes on the basis of the walking state, the walking state of the user can be detected more accurately, and more favorable hearing aid processing desired by the user can be provided.

Though this embodiment describes the hearing aid, the same structure is applicable to other acoustic equipment.

Embodiment 3

Figure 7:
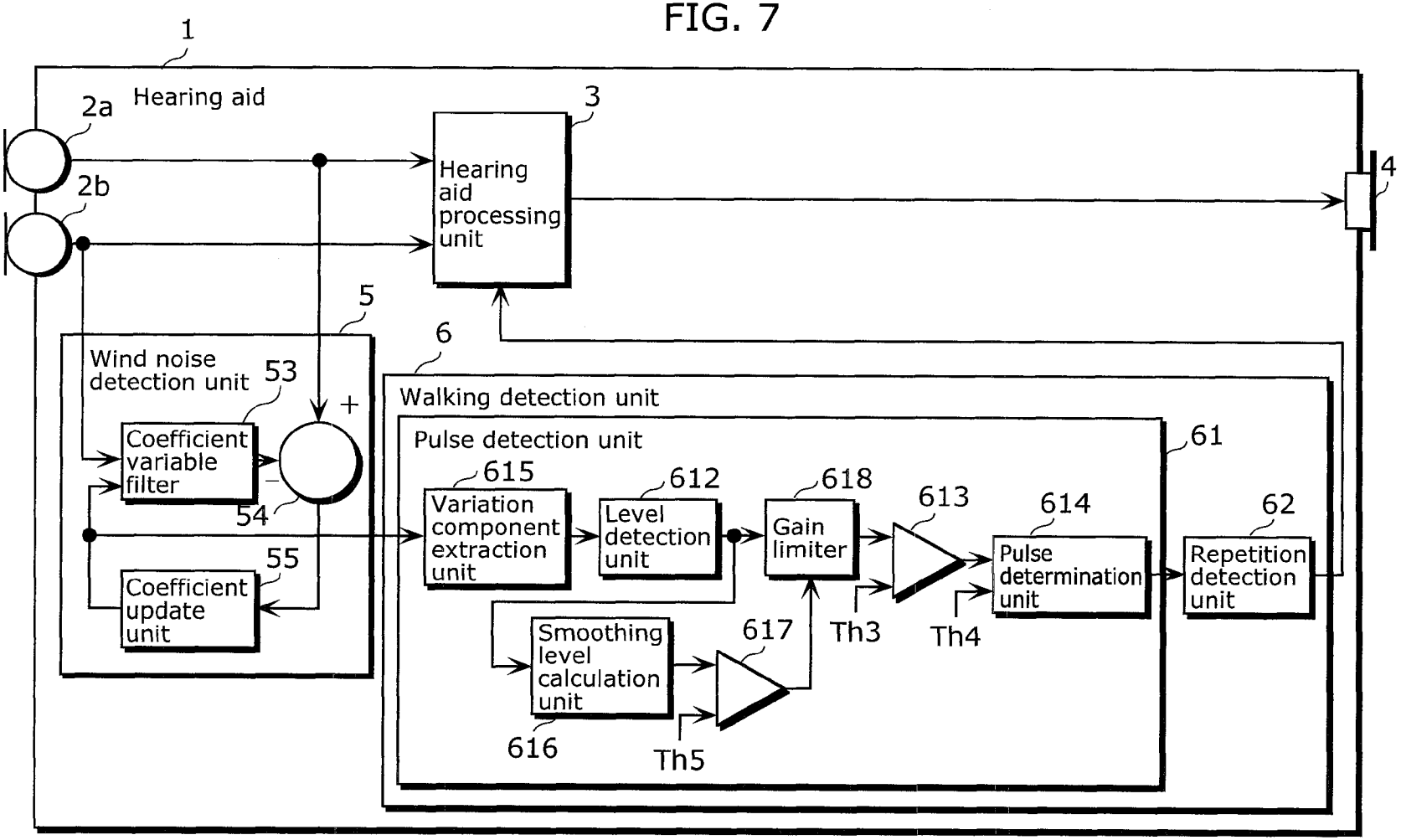
FIG. 7 is a block diagram showing a detailed structure of a hearing aid in Embodiment 3 of the present invention.
Figure 8:
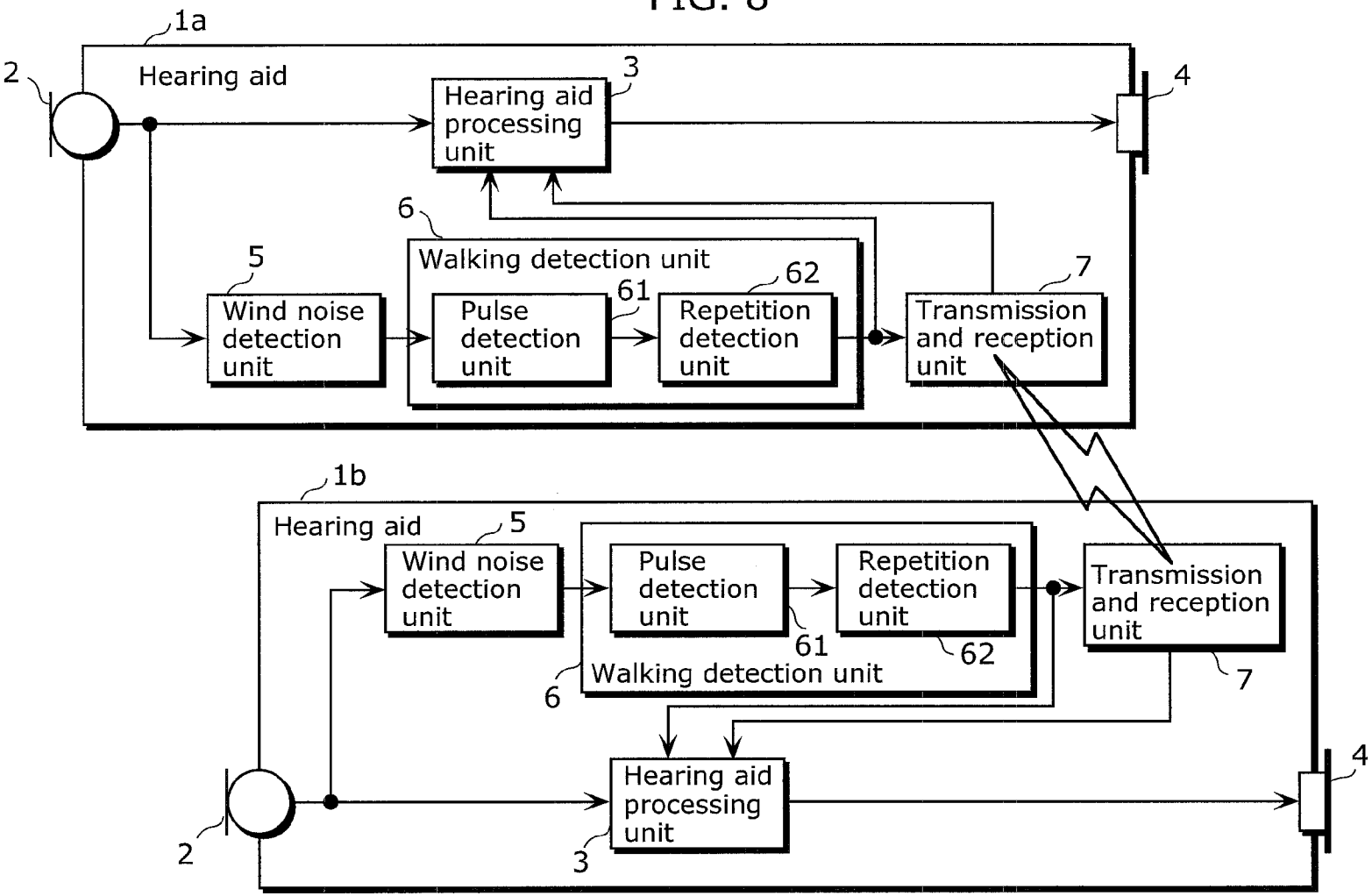
FIG. 8 is a block diagram showing a detailed structure of a hearing aid in Embodiment 4 of the present invention.

The following describes a structure and an operation of the hearing aid 1 according to Embodiment 3 of the present invention, with reference to FIGS. 7 and 9. In the following, description of the same components as those in the hearing aid 1 in Embodiments 1 and 2 is omitted, and the wind noise detection unit 5 and the pulse detection unit 61 in the walking detection unit 6 in this embodiment are described in detail.

The wind noise detection unit 5 in this embodiment includes the adaptive filter that includes the coefficient variable filter 53, the subtractor 54, and the coefficient update unit 55 as in Embodiment 2. However, the wind noise detection unit 5 in this embodiment differs from that in Embodiment 2, in that the filter coefficient of the coefficient variable filter 53 is outputted.

The pulse detection unit 61 in the walking detection unit 6 includes a variation component extraction unit 615, the level detection unit 612, a comparator 617, a gain limiter 618, the comparator 613, and the pulse determination unit 614.

The wind noise detection unit 5 outputs the filter coefficient of the coefficient variable filter 53 instead of the error signal of the adaptive filter, as the wind noise occurrence signal (Step S902). As mentioned earlier in Embodiment 2, in the case where only a speech signal is included in the acoustic signals acquired by the microphones 2*a* and 2*b*, the two input acoustic signals are approximately identical signals merely with a delay corresponding to the distance between the microphones. This being so, the adaptive filter using the acoustic signal acquired by the microphone 2*b* as the main signal and the acoustic signal acquired by the microphone 2*a* as the reference signal converges, as a result of which the filter coefficient converges to a specific value. On the other hand, in the case where wind noise is included in the acoustic signals acquired by the microphones 2*a* and 2*b*, the two input acoustic signals are uncorrelated with each other. Accordingly, the adaptive filter does not converge but diverges, as a result of which the filter coefficient diverges, too. Here, the wind noise occurrence signal is a signal indicating a continuous quantity corresponding to the amount of wind noise occurrence, and converges to a specific value when wind noise does not occur, and diverges to a larger variation when wind noise increases. The use of such a filter coefficient enables the wind noise occurrence state to be detected more accurately.

The pulse detection unit 61 detects the pulse-like variation of the wind noise occurrence signal, from a high frequency component level of the wind noise occurrence signal (Step S903). In the case where wind noise occurs, the filter coefficient of the adaptive filter in the wind noise detection unit 5 diverges and the variation of the wind noise occurrence signal increases, so that the high frequency component level of the wind noise occurrence signal increases. Accordingly, the wind noise occurrence signal from the wind noise detection unit 5 is inputted to the variation component extraction unit 615 which is a high-pass filter or the like, thereby extracting the high frequency component. The level detection unit 612 calculates a high frequency component level signal by, for example, taking an absolute value of the extracted high frequency component signal. The smoothing level calculation unit 616 performs smoothing on the high frequency component level signal. The comparator 617 compares the smoothed high frequency component level signal with a predetermined threshold (Th5). In the case where the smoothed high frequency component level signal is equal to or more than the threshold, the gain limiter 618 controls a gain of the high frequency component level signal.

When the input to the pulse detection unit 61 is the wind noise occurrence signal of normal wind, wind noise occurs continuously, and so the smoothed high frequency component level calculated by the smoothing level calculation unit 616 exceeds the predetermined threshold (Th5) and approaches the high frequency component level calculated by the level detection unit 612. Therefore, the high frequency component level signal is gain-controlled by the gain limiter 618 to be significantly attenuated, and outputted from the gain limiter 618.

When the input of the pulse detection unit 61 is the wind noise occurrence signal during walking, on the other hand, wind noise occurs instantaneously, and so the high frequency component level signal has an instantaneous increase. Accordingly, the smoothed high frequency component level calculated by the smoothing level calculation unit 616 has almost no change. Therefore, the high frequency component level signal is outputted without being gain-controlled by the gain limiter 618.

Thus, by gain-controlling the high frequency component level of the wind noise occurrence signal according to the level of the smoothed high frequency component level signal, the pulse-like variation of the wind noise occurrence signal passes through the gain limiter 618 as a pulse-like signal, without being affected by the gain control. In the case where the wind noise occurrence signal has a continuous variation, on the other hand, the wind noise occurrence signal is attenuated as a result of the gain control by the gain limiter 618.

The comparator 613 compares the output of the gain limiter 618 with the predetermined threshold (Th3). The pulse determination unit 614 counts a duration of a time section in which the output of the gain limiter 618 exceeds the threshold (Th3), and compares the duration of the time section with the predetermined threshold (Th4). In the case where the duration of the time section in which the high frequency component level signal of the wind noise occurrence signal gain-controlled by the gain limiter 618 exceeds the predetermined threshold (Th3) is equal to or less than the predetermined threshold (Th4), the pulse determination unit 614 determines that the wind noise occurrence signal has a pulse-like variation. Note that the predetermined threshold (Th5) for specifying a gain control start level of the high frequency component level signal may be experimentally determined to a value that allows a pulse-like variation to be detected. In this embodiment, the threshold (Th5) is set to a value slightly smaller than the threshold (Th3), as an example. The predetermined threshold (Th5) may be fixed. Alternatively, the predetermined threshold (Th5) may be variable in such a manner that changes according to the extracted high frequency component level. By changing the predetermined threshold (Th5) according to the variation amount of the filter coefficient, it is possible to follow the amount of wind noise occurrence that varies depending on the walking speed. This contributes to more accurate walking state detection as in Embodiment 2.

This embodiment describes the case where the variation component extraction unit 615 uses a high-pass filter to extract the variation component of the wind noise occurrence signal. As an alternative, a band-pass filter for removing the vicinity of a Nyquist component may be used in order to remove an extreme variation component of wind noise occurrence clearly caused by a strong wind.

By extracting a time section with a large variation amount of the wind noise occurrence signal from the high frequency component level of the wind noise occurrence signal as in this embodiment, more accurate pulse detection can be achieved, as compared with the case of simply detecting a duration of the wind noise occurrence signal that exceeds the predetermined threshold as in Embodiment 2.

Thus, the walking detection unit 6 detects the walking state of the user, and outputs the walking detection signal to the hearing aid processing unit 3.

The hearing aid processing unit 3 performs hearing aid processing according to the walking detection signal, as described in Embodiments 1 and 2. By detecting whether or not the user is in the walking state through the use of the variation of the filter coefficient of the adaptive filter and switching between hearing aid modes on the basis of the walking state, more favorable hearing aid processing desired by the user can be provided.

Though this embodiment describes the hearing aid, the same structure is applicable to other acoustic equipment such as a portable music player, a headphone or an earphone with a noise canceling function, and the like.

Embodiment 4

The following describes a structure and an operation of hearing aids 1*a* and 1*b* in Embodiment 4 of the present invention.

The hearing aids 1*a* and 1*b* in this embodiment each include a transmission and reception unit 7. In the following, description of the same components as those in the hearing aid 1 in Embodiments 1 to 3 is omitted, and the transmission and reception unit 7 is described in detail.

The transmission and reception unit 7 in the hearing aid 1*a* performs transmission and reception of the walking detection signal detected by the walking detection unit 6, with the hearing aid 1*b* other than the hearing aid 1*a*. The transmission and reception unit 7 in each of the hearing aids 1*a* and 1*b* transmits and receives the walking detection signal detected by the walking detection unit 6 wirelessly or via a cable between the hearing aids 1*a* and 1*b*, and shares the walking detection signal.

Wind noise that occurs when walking is typically wind noise from the front, and so the walking state is supposed to be simultaneously detected by the hearing aids 1*a* and 1*b* worn at both ears of the user. The transmission and reception unit 7 shares the walking detection state between both hearing aids. Only in the case where the walking state is detected by both hearing aids, it is determined that the user is in the walking state. In the case where the walking state is detected by one of the hearing aids but is not detected by the other hearing aid, the walking detection signal of the hearing aid detecting the walking state is disabled (=Low). This makes it possible to achieve accurate walking detection, by preventing false walking detection. Moreover, by controlling the same hearing aid processing according to the result of walking detection between both ears, the user's discomfort can be removed. That is, when the walking state is detected only by one of the hearing aids 1*a* and 1*b* and is not detected by the other hearing aid, the hearing aid processing in the hearing aid detecting the walking state is modified to the hearing aid processing corresponding to the case where the walking state is not detected.

Alternatively, when the walking state is detected by at least one of the hearing aids 1*a* and 1*b*, the walking detection signal of the hearing aid detecting the walking state may be enabled (=High). In so doing, it is possible to sensitively react to wind noise. In this case, too, by controlling the same hearing aid processing according to the result of walking detection between both ears, the user's discomfort can be removed. That is, when the walking state is detected by at least one of the hearing aids 1*a* and 1*b*, the hearing aid processing in the hearing aid not detecting the walking state is modified to the hearing aid processing corresponding to the case where the walking state is detected.

As an alternative, according to the walking detection signal of each hearing aid, only a hearing aid detecting the walking state may determine that the user is in the walking state.

Combination of the Embodiments

Though the present invention has been described by way of Embodiments 1 to 4, the present invention is not limited to Embodiments 1 to 4, and also includes a form of combining the structures of Embodiments 1 to 4.

In detail, the output of the low-pass filter 51 in Embodiment 1 may be inputted to the pulse detection unit 61 in Embodiment 2 or 3 as a wind noise occurrence amount. Moreover, the result of determining the output of the adaptive filter in Embodiment 2 or 3 on the basis of the threshold may be inputted to the edge detection unit 611 in Embodiment 1 as a wind noise occurrence flag. Furthermore, the error signal of the adaptive filter in Embodiment 2 may be inputted to the variation component extraction unit 615 in Embodiment 3. Other arbitrary combinations are also included in the present invention. According to these structures, too, by detecting the walking state and switching between hearing aid modes on the basis of the detected walking state as described above, more favorable hearing aid processing desired by the user can be provided.

Figure 10:
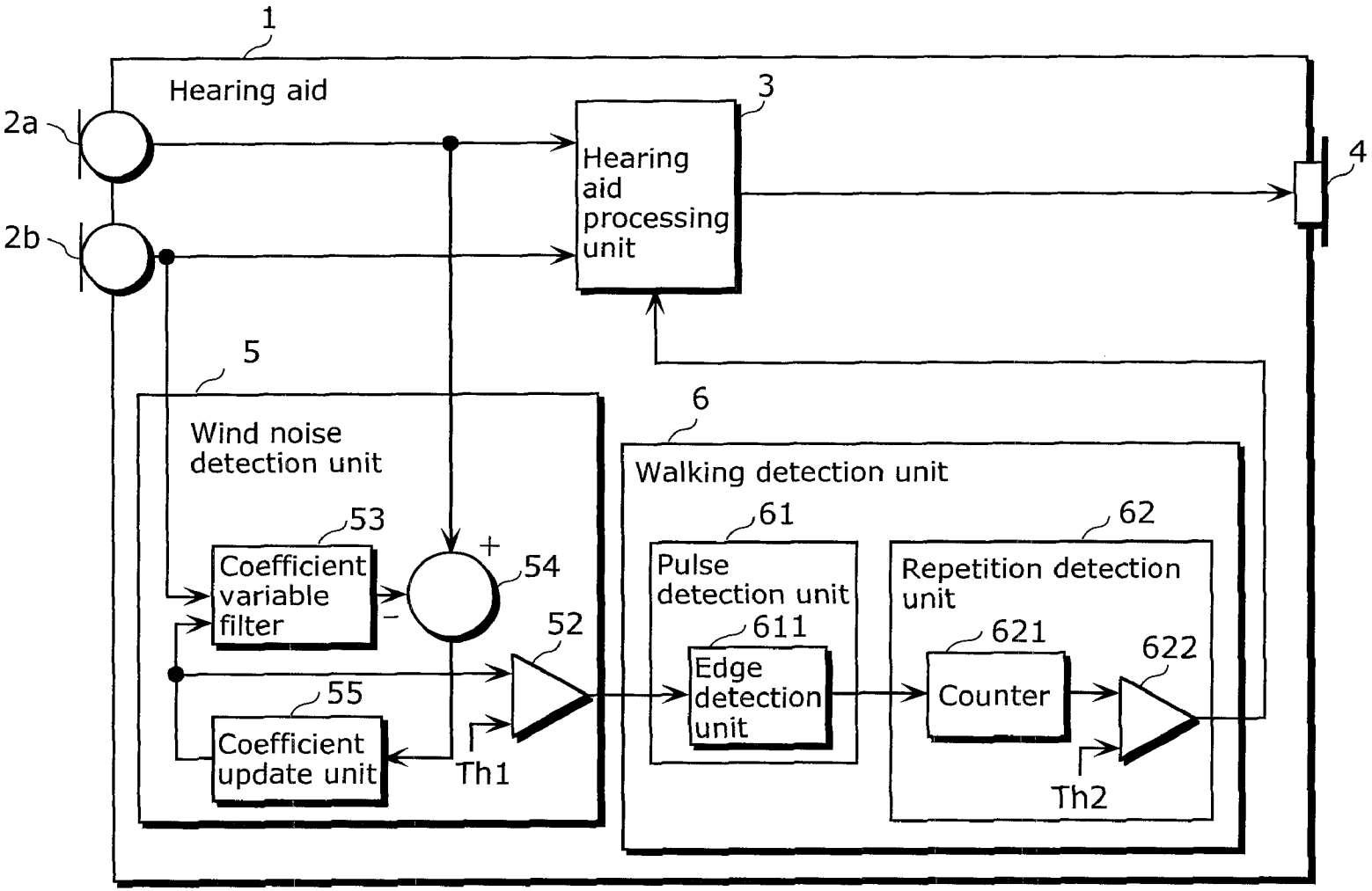
FIG. 10 is a block diagram showing an example of a detailed structure of a hearing aid in the case of combining the embodiments of the present invention.

FIG. 10 is a block diagram showing a structure in which the result of determining the filter coefficient of the coefficient variable filter 53 in Embodiment 3 on the basis of the threshold by inputting it to the comparator 52 in Embodiment 1 is inputted to the edge detection unit 611 in Embodiment 1 as a wind noise occurrence flag.

Figure 11:
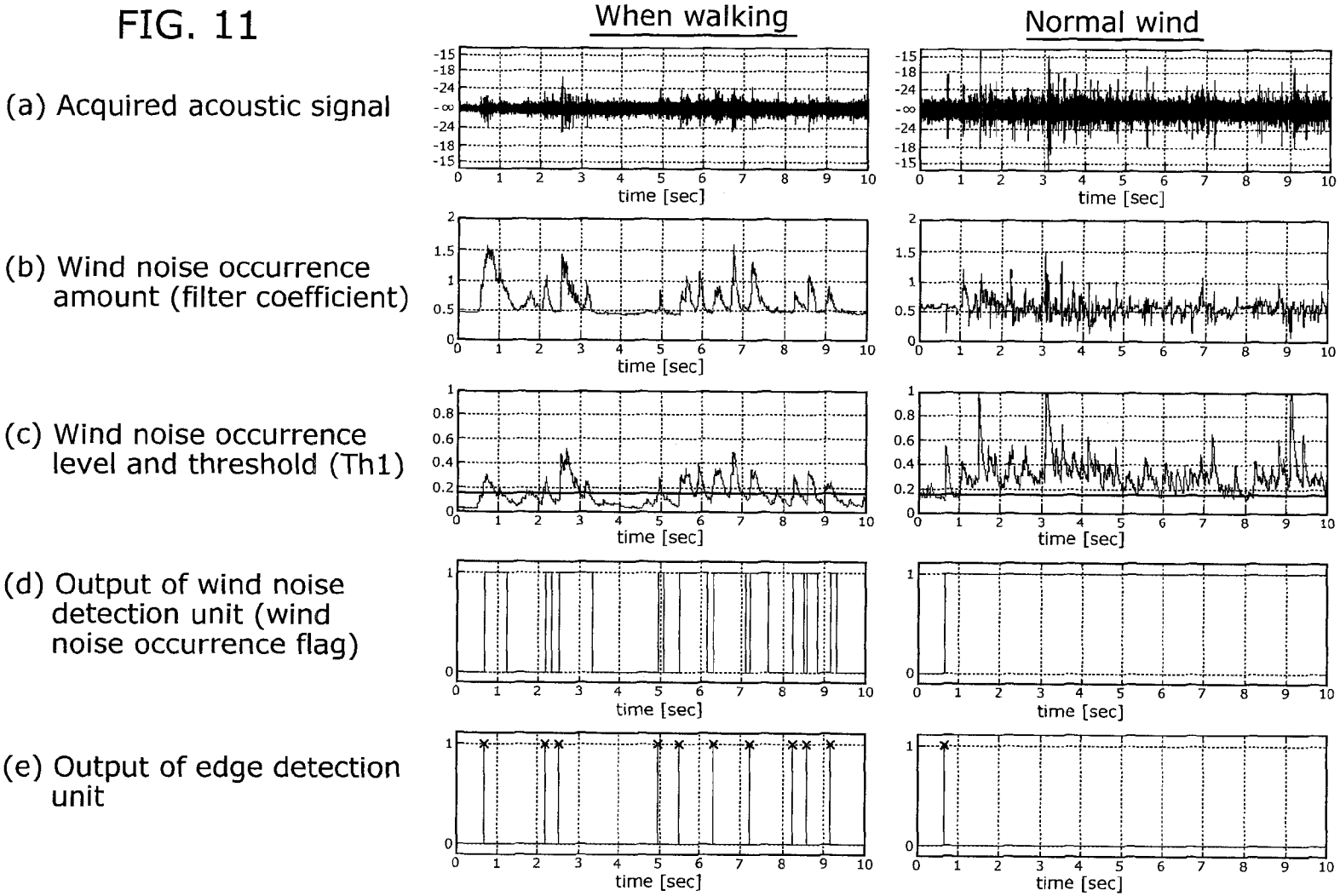
FIG. 11 is a diagram showing an output signal (experimental data) of each processing unit in walking detection by the hearing aid shown in FIG. 10.

FIG. 11 shows experimental data indicating walking detection in the structure shown in FIG. 10. FIG. 11 shows output data and intermediate data of the wind noise detection unit 5 and the walking detection unit 6, when the user is walking and when normal wind is blowing while the user is stationary.

The filter coefficient updated by the coefficient update unit 55 so as to minimize the output error of the coefficient variable filter 53 through the use of the acoustic signals (see FIG. 11(*a*)) acquired by the microphones 2*a* and 2*b* is set as the wind noise occurrence amount (see FIG. 11(*b*)). The comparator 52 compares the extracted wind noise occurrence level with the predetermined threshold (Th1) (see FIG. 11(*c*)), thereby detecting the wind noise occurrence (see FIG. 11(*d*)). Though the wind noise occurrence amount (see FIG. 11(*b*)) is similar between when walking and when normal wind is blowing, the wind noise occurrence frequency is different. Wind noise is continuously detected when normal wind is blowing, whereas wind noise is intermittently detected when walking (see FIG. 11(*d*)). As a result, when taking a transition of the wind noise occurrence flag from Low to High as an example (see FIG. 11(*e*)), it is detected that wind noise repeatedly occurs when walking, with it being possible to determine that the user is in the walking state.

Each of the structures other than the transmission and reception unit 7 in the hearing aids 1*a* and 1*b* in Embodiment 4 may be any of the structures in Embodiments 1 to 3, or a combination of the structures in Embodiments 1 to 3. Furthermore, the structures other than the transmission and reception unit 7 in the hearing aids 1*a* and 1*b* may be different.

(Other Variations)

The present invention also includes the following embodiments.

(1) The components that constitute each of the above devices may be partly or wholly realized by one system LSI. The system LSI is an ultra-multifunctional LSI produced by integrating a plurality of components on one chip, and is actually a computer system that includes a microprocessor, a ROM, a RAM, and the like. A computer program is stored on the RAM. Functions of the system LSI can be achieved by the microprocessor operating in accordance with the computer program.

(2) The components that constitute each of the above devices may be partly or wholly realized by an IC card or a single module that is removably connectable to the device. The IC card or the module is a computer system that includes a microprocessor, a ROM, a RAM, and the like. The IC card or the module may include the ultra-multifunctional LSI of the above (1). Functions of the IC card or the module can be achieved by the microprocessor operating in accordance with the computer program. The IC card or the module may be tamper resistant.

(3) The present invention may also be the method described above. The present invention may also be a computer program that realizes the method by a computer. The present invention may also be a digital signal formed by the computer program.

The present invention may also be a computer-readable recording medium, such as a flexible disk, a hard disk, a CD-ROM, an MO, a DVD, a DVD-ROM, a DVD-RAM, a Blu-ray Disc (BD), or a semiconductor memory, on which the computer program or the digital signal is recorded. Conversely, the present invention may be the digital signal recorded on such a recording medium.

The present invention may also be the computer program or the digital signal transmitted via a network such as an electric communication line, a wired or wireless communication line, or the Internet, data broadcasting, and the like.

The present invention may also be a computer system that includes a microprocessor and a memory. In this case, the computer program can be stored in the memory, with the microprocessor operating in accordance with the computer program.

The computer program or the digital signal may be provided to another independent computer system by distributing the recording medium on which the computer program or the digital signal is recorded, or by transmitting the computer program or the digital signal via the network and the like. The independent computer system may then execute the computer program or the digital signal to function as the present invention.

(4) The above embodiments and variations may be freely combined.

INDUSTRIAL APPLICABILITY

The hearing aid according to the present invention is useful as an adaptive hearing aid technique for automatically switching between a plurality of hearing aid processing according to a surrounding environment.

REFERENCE SIGNS LIST

1, 1*a*, 1*b*, 1001, 2001 Hearing aid
2, 2*a*, 2*b* Microphone
3, 1003, 2003 Hearing aid processing unit
4 Receiver
5 Wind noise detection unit
6 Walking detection unit
7 Transmission and reception unit
31 Directionality synthesis unit
32 Directionality control unit
33 Amplifier
51 Low-pass filter
52, 613, 617, 622 Comparator
53 Coefficient variable filter
54 Subtractor
55 Coefficient update unit
61 Pulse detection unit
62 Repetition detection unit
611 Edge detection unit
612 Level detection unit
614 Pulse determination unit
615 Variation component extraction unit
616 Smoothing level calculation unit
618 Gain limiter
621 Counter
1002, 2002*a*, 2002*b* Microphone
1004, 2004 Receiver
1005, 2005 Signal analysis unit
1006 Signal identification unit
1007 Training device

The invention claimed is:

1. A hearing aid comprising: a sound acquisition unit configured to acquire an external acoustic signal; a hearing aid processing unit configured to switch between a plurality of algorithms to perform hearing aid processing on the acquired acoustic signal; and an output unit configured to output the acoustic signal on which the hearing aid processing has been performed, said hearing aid comprising:

a wind noise detection unit configured to detect wind noise that is mixed in the acquired acoustic signal during the acquisition; and a time variation detection unit configured to detect a time variation of the detected wind noise, wherein said time variation detection unit includes:

a pulse detection unit configured to detect a pulse-like variation of the wind noise, as a variation of the wind noise; and a repetition detection unit configured to detect whether or not the detected pulse-like variation repeats with time, and said hearing aid processing unit is configured to switch between the plurality of algorithms to perform the hearing aid processing on the acquired acoustic signal, on the basis of the detected time variation of the wind noise.

2. The hearing aid according to claim 1, wherein said sound acquisition unit includes a first microphone and a second microphone, said wind noise detection unit includes a coefficient variable filter unit configured to update, using an acoustic signal acquired by said first microphone as a main signal and an acoustic signal acquired by said second microphone as a reference signal, a filter coefficient so as to minimize a difference from the reference signal, and said wind noise detection unit is configured to detect, as the wind noise, an error signal indicating a difference between an estimation signal and the reference signal.

3. The hearing aid according to claim 2, wherein said hearing aid processing unit includes:

a directionality synthesis unit configured to generate a directional signal having directional sensitivity in a first direction and an omnidirectional signal having no directional sensitivity in a specific direction, using the acoustic signal acquired by said first microphone and the acoustic signal acquired by said second microphone; and a directionality control unit configured to be capable of switching an output of said directionality synthesis unit between the directional signal and the omnidirectional signal, wherein said directionality control unit is configured to switch the output of said directionality synthesis unit to the directional signal in the case where said repetition detection unit does not detect that the pulse-like variation repeats with time, and to the omnidirectional signal in the case where said repetition detection unit detects that the pulse-like variation repeats with time.

4. The hearing aid according to claim 1, wherein said sound acquisition unit includes a first microphone and a second microphone, said wind noise detection unit includes a coefficient variable filter unit configured to update, using an acoustic signal acquired by said first microphone as a main signal and an acoustic signal acquired by said second microphone as a reference signal, a filter coefficient so as to minimize a difference between an estimation signal and the reference signal, the estimation signal being obtained by filtering the main signal, and said wind noise detection unit is configured to detect, as the wind noise, the filter coefficient in said coefficient variable filter unit.

5. The hearing aid according to claim 4, wherein said pulse detection unit includes:

a variation component extraction unit configured to extract a variation component of the filter coefficient; and a gain control unit configured to control a gain of the variation component on the basis of a smoothing level of the extracted variation component, and said pulse detection unit is configured to detect a pulse-like variation of the filter coefficient, on the basis of a level of the gain-controlled variation component.

6. The hearing aid according to claim 5, wherein said gain control unit is configured to control the gain of the variation component, on the basis of a duration for which the smoothing level of the variation component exceeds a predetermined threshold.

7. The hearing aid according to claim 1 worn at one ear of a user, said hearing aid further comprising a transmission and reception unit configured to transmit the time variation of the wind noise detected by said time variation detection unit to another hearing aid worn at an other ear of the user, and receive a time variation of wind noise detected by the other hearing aid, wherein said hearing aid processing unit is configured to switch between the plurality of algorithms to perform the hearing aid processing on the acquired acoustic signal, on the basis of the time variation of the wind noise detected by said time variation detection unit and the time variation of the wind noise received by said transmission and reception unit.

8. A hearing aid system comprising a pair of hearing aids according to claim 1, wherein each of said hearing aids further includes a transmission and reception unit configured to transmit the time variation of the wind noise detected by said time variation detection unit to an other one of said hearing aids, and receive a time variation of wind noise detected by the other hearing aid, wherein said hearing aid processing unit is configured to switch between the plurality of algorithms to perform the hearing aid processing on the acquired acoustic signal, on the basis of the time variation of the wind noise detected by said time variation detection unit and the time variation of the wind noise received by said transmission and reception unit.

9. A computer-readable recording medium on which a program is recorded, the program causing a computer to function as each unit included in the hearing aid according to claim 1.

10. A hearing aid method in a hearing aid that includes: a sound acquisition unit that acquires an external acoustic signal; a hearing aid processing unit that switches between a plurality of algorithms to perform hearing aid processing on the acquired acoustic signal; and an output unit that outputs the acoustic signal on which the hearing aid processing has been performed, said hearing aid method comprising:

detecting, by a wind noise detection unit, wind noise that is mixed in the acquired acoustic signal during the acquisition, by detecting a pulse-like variation of the wind noise as a variation of the wind noise, and detecting whether or not the detected pulse-like variation repeats with time;

detecting, by a time variation detection unit, a time variation of the detected wind noise; and switching, by the hearing aid processing unit, between the plurality of algorithms to perform the hearing aid processing on the acquired acoustic signal, on the basis of the detected time variation of the wind noise.

11. An integrated circuit in a hearing aid including: a sound acquisition unit configured to acquire an external acoustic signal; a hearing aid processing unit configured to switch between a plurality of algorithms to perform hearing aid processing on the acquired acoustic signal; and an output unit configured to output the acoustic signal on which the hearing aid processing has been performed, said integrated circuit comprising:

a wind noise detection unit configured to detect wind noise that is mixed in the acquired acoustic signal during the acquisition; and a time variation detection unit configured to detect a time variation of the detected wind noise, wherein said time variation detection unit includes:

a pulse detection unit configured to detect a pulse-like variation of the wind noise, as a variation of the wind noise; and a repetition detection unit configured to detect whether or not the detected pulse-like variation repeats with time, and said hearing aid processing unit is configured to switch between the plurality of algorithms to perform the hearing aid processing on the acquired acoustic signal, on the basis of the detected time variation of the wind noise.

* * * * *